US012257519B1

(12) United States Patent
Ye

(10) Patent No.: US 12,257,519 B1
(45) Date of Patent: Mar. 25, 2025

(54) MULTIFUNCTIONAL TOY FOR EARLY CHILDHOOD EDUCATION

(71) Applicant: Zhanheng Ye, Zhejiang (CN)

(72) Inventor: Zhanheng Ye, Zhejiang (CN)

( * ) Notice: Subject to any disclaimer, the term of this patent is extended or adjusted under 35 U.S.C. 154(b) by 0 days.

(21) Appl. No.: 18/769,411

(22) Filed: Jul. 11, 2024

(51) Int. Cl.
*A63H 33/04* (2006.01)
*A63G 21/02* (2006.01)
*A63G 11/00* (2006.01)

(52) U.S. Cl.
CPC ..... *A63G 21/02* (2013.01); *A63G 11/00* (2013.01)

(58) Field of Classification Search
CPC . A63H 3/00; A63H 3/16; A63H 33/04; A63H 33/06; A63H 33/08; A63H 33/084; A63H 33/062; A63H 33/086; A63H 33/105; G09B 1/36; A63G 11/00; A63G 21/02
USPC .... 472/85, 102, 105, 117, 119–127; 434/81, 434/403
See application file for complete search history.

(56) References Cited

U.S. PATENT DOCUMENTS 3,946,516 A * 3/1976 Wirth ..... A63F 7/3622 446/117
4,279,096 A * 7/1981 Guidry ..... A63H 33/00 446/69
4,708,684 A * 11/1987 Chen ..... A63H 33/08 446/124
4,764,143 A * 8/1988 Gat ..... B65D 81/361 446/120
5,395,279 A * 3/1995 McCann ..... A63H 33/00 446/490
5,638,974 A * 6/1997 Mann ..... B65D 81/361 220/23.86
6,702,642 B1 * 3/2004 Parein ..... A63H 33/08 446/120
2010/0068967 A1 * 3/2010 Hume ..... A63F 9/0873 446/236

* cited by examiner

*Primary Examiner* — Kien T Nguyen
(74) *Attorney, Agent, or Firm* — Hawaii Patent Services; Nathaniel K Fedde; Kenton N. Fedde

(57) ABSTRACT

A multifunctional toy for early childhood education comprises a plurality of basic elements and at least one expansion element, wherein the basic element has a rollable outer surface and an inner cavity for sleeving other basic elements, and a connector is arranged between at least two basic elements, and the connector is installed between the two basic elements in a mutually matched manner; and a plurality of steps are detachably connected on the connector, and the expansion element is detachably connected with the basic elements.

16 Claims, 10 Drawing Sheets

MULTIFUNCTIONAL TOY FOR EARLY CHILDHOOD EDUCATION

TECHNICAL FIELD

The present invention relates to the technical field of children's teaching AIDS, in particular to a multifunctional toy for early childhood education.

BACKGROUND

There are many kinds of toys for children's early education, including but not limited to building blocks, scientific toys, enlightenment toys (such as soft toys, music toys, etc.), early education toys (such as puzzles and sand paintings), sports toys (such as baby carriages and hula hoops), model toys (such as airplane models, architectural models and car models) and the like.

At present, the existing roller-type early education toys only have the function of rolling and playing, and the function is single.

For example, in the existing China patent, the utility model patent with the number of CN211578224U discloses an "Environment-friendly child sensory integration simulation tire training teaching aid".

The roller-type early childhood education toy of this patent is set independently, only has the function of rolling play, and has a single function, but does not have the function of expansion and combination.

Therefore, it is necessary to put forward a new type of toy for early childhood education, which has the function of expansion and combination and functional diversification, and is suitable for various application scenarios.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The present invention provides a multifunctional toy for early childhood education to solve that problems that the exist early childhood education toy is independently arranged with a single function and does not have the function of expanding combination.

In order to achieve the above object, the present invention adopts the following technical solutions:

the present invention provides a multifunctional toy for early childhood education, which includes a plurality of basic elements and at least one expansion element;

wherein, the basic element has a rollable outer surface and an inner cavity for sleeving other basic elements;

a connector is arranged between at least two basic elements, and the connector is installed between the two basic elements in a mutually matched manner; and wherein, the connector is detachably connected with a plurality of steps;

the expansion element is detachably connected with the basic elements.

The present invention further provides a multifunctional toy for early childhood education, which includes a plurality of basic elements and at least one expansion element;

wherein, a connector is arranged between at least two basic elements, and the connector is detachably connected between the two basic elements; and the expansion element is detachably connected with the basic elements.

The present invention further provides a multifunctional toy for early childhood education, which includes a plurality of rollers and at least one expansion element;

wherein a connector is arranged between at least two rollers, and the connector is detachably connected between the two rollers; and the expansion element is detachably connected with the rollers.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

Figure 1:
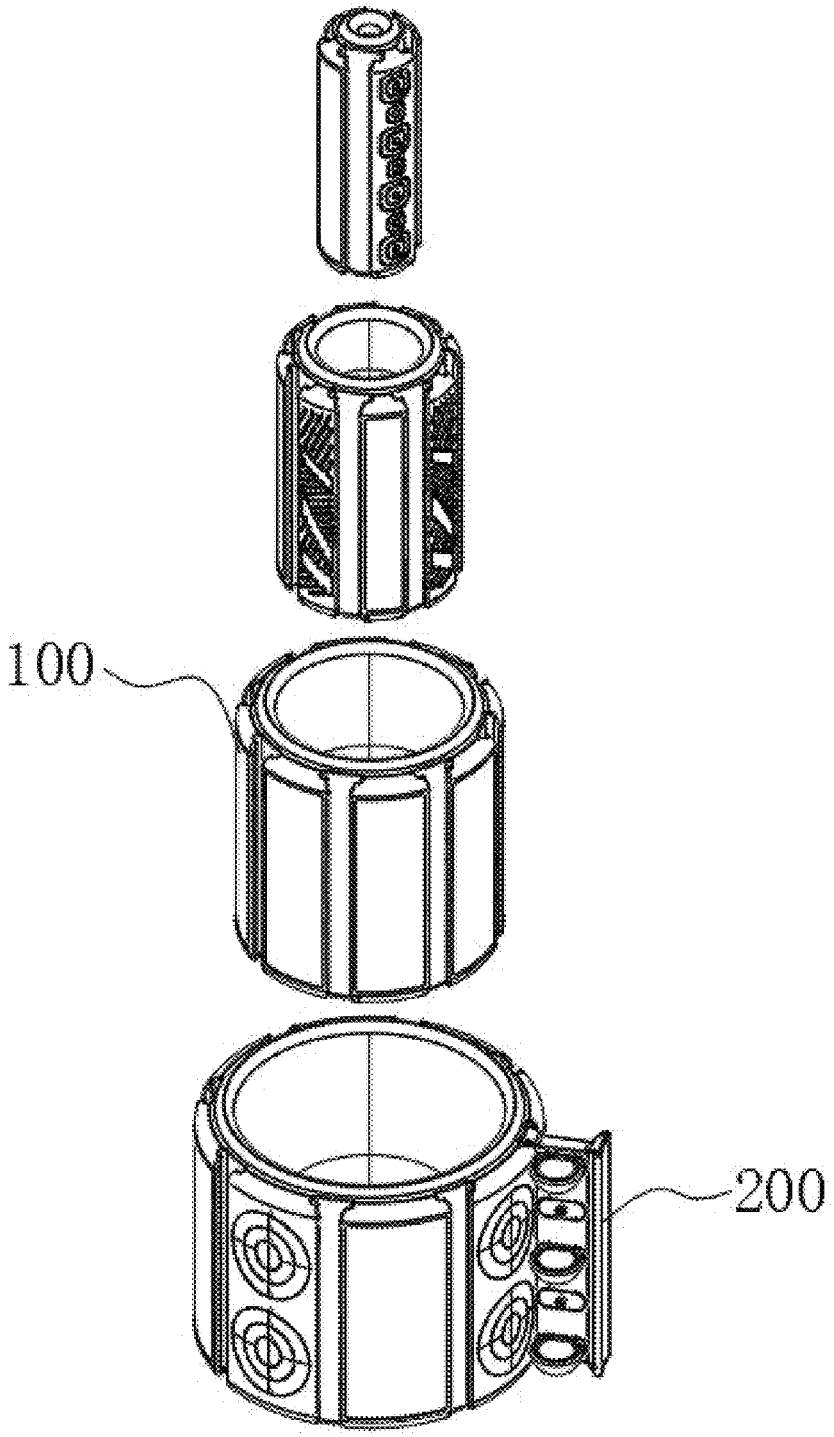
FIG. 1 is a structural schematic diagram of a basic element of the present invention.

In the figures: Basic element (100); Roller (101); A sleeving area (102); Rolling surface (103); Dovetail groove (104); Upright end face (105); Connector (200); Dovetail strip (201); Extension part (202); Mounting groove (203); Connecting plate (204); Step (205); Bolt (206); Expansion element (300); Slide (301); Connecting part (302).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

Embodiment 1

As a preferred embodiment of the application of the present invention, the application of the present invention provides a multifunctional toy for early childhood education, which includes a plurality of basic elements 100 and at least one expansion element 300, wherein the basic element 100 has a rollable outer surface and an inner cavity for sleeving other basic elements 100; a connector 200 is arranged between at least two basic elements 100, and the connector 200 is installed between the two basic elements 100 in a mutually matched manner; the connector 200 is detachably connected with a plurality of steps 205; the expansion element 300 is detachably connected with the basic elements 100.

As shown in FIG. 1, the basic element 100 includes a roller 101 and a sleeving area 102. The roller 101 is a cylinder with a rollable outer circumferential surface. Wherein, the sizes of the plurality of rollers 101 are different, the radius size of the largest roller 101 is preferably 500 mm, and the radius size from the largest roller 101 to the smallest roller 101 gradually decreases. The basic element 100 can be placed on the ground for rolling through the rollable outer surface of the roller 101. The roller 101 is in the shape of a hollow sleeve, and its interior is set as a sleeving area 102. The sleeving area 102 has an inner cavity that can accommodate other basic elements 100, and the sleeving area 102 can be used to sleeve other small-sized rollers 101. When children need to organize and store the basic elements 100, they can put the smallest roller 101 into the largest roller 101 in turn. This structure can not only save space and improve space utilization, but also greatly facilitate the transportation of the basic elements 100. This design directly solves the problem of storage and space utilization of the basic elements 100, and brings great convenience and practicality to children.

Figure 2:
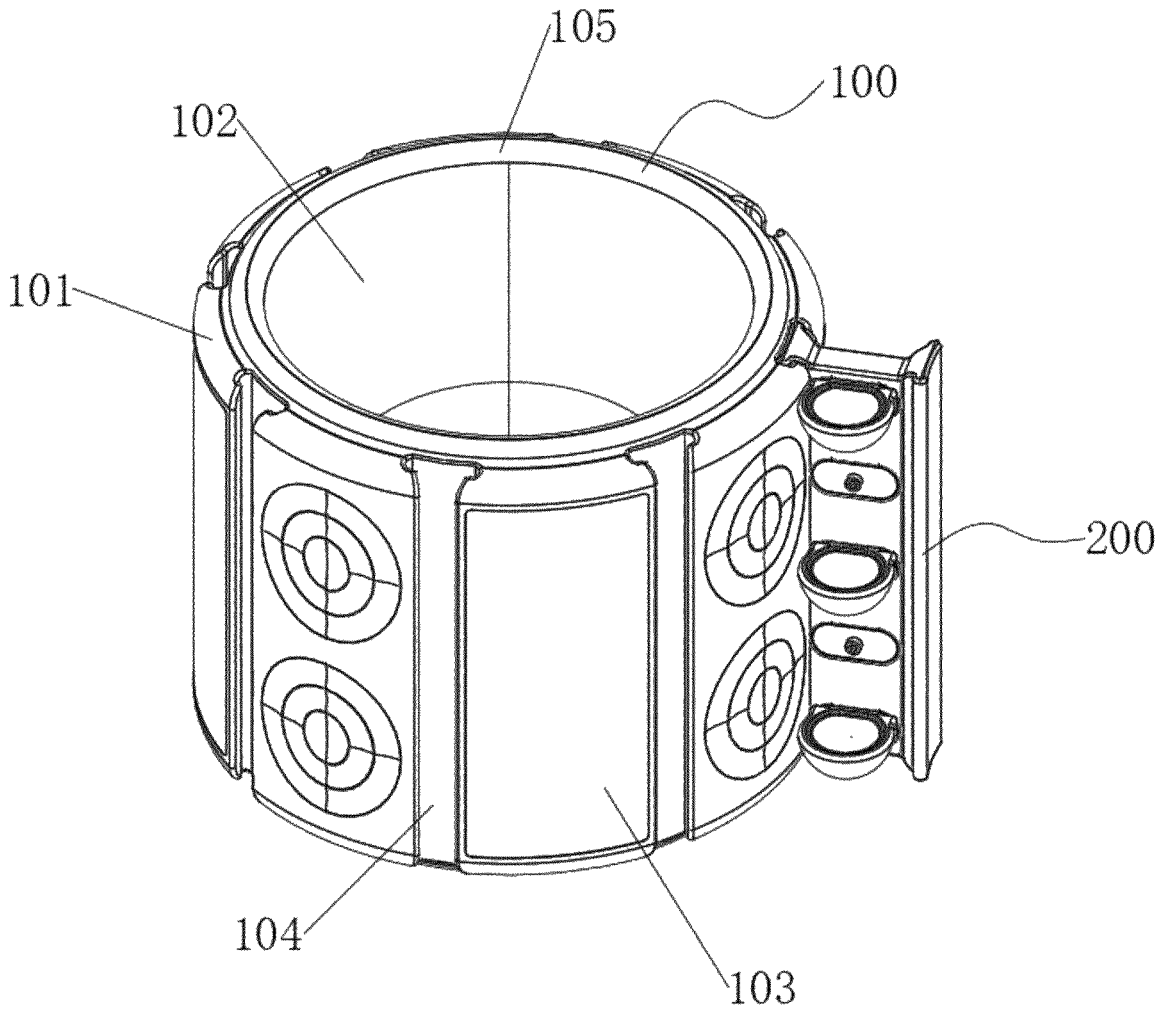
FIG. 2 is a state diagram of the basic element of the present invention when a connector is installed.

As shown in FIG. 2, the basic element 100 includes a roller 101, and a rolling surface 103 is provided on the outer circumferential surface of the roller 101. The two end faces of the rolling surface 103 perpendicular to the roller 101 are called upright end faces 105. The rolling surface 103 is uniformly provided with dovetail grooves 104. Dovetail groove 104 is arranged on rolling surface 103 in a penetrating manner along the length direction of rolling surface 103, and the dovetail grooves 104 are provided with openings along the sagittal direction of roller 101. Dovetail grooves 104 are opposite to dovetail strip 201 in shape, and both ends of dovetail grooves 104 are provided with openings to accommodate connector 200.

Specifically, when children need to use the basic element 100 to roll, they can roll by the rolling surface 103 arranged on the outer circumferential surface of the roller 101. The rolling surface 103 is provided with special lines, which can increase the friction and have a certain aesthetic effect on the rolling surface 103. When children want to combine the basic element 100 with other basic elements 100, the upright end faces 105 of the roller 101 can be vertically placed, and after being placed, they can be respectively inserted into the dovetail grooves 104 opposite to the two rollers 101 with connectors 200, so that the basic elements 100 can be combined into different states. The various combinations can improve children's hands-on ability and exercise children's hand-eye coordination.

Figure 6:
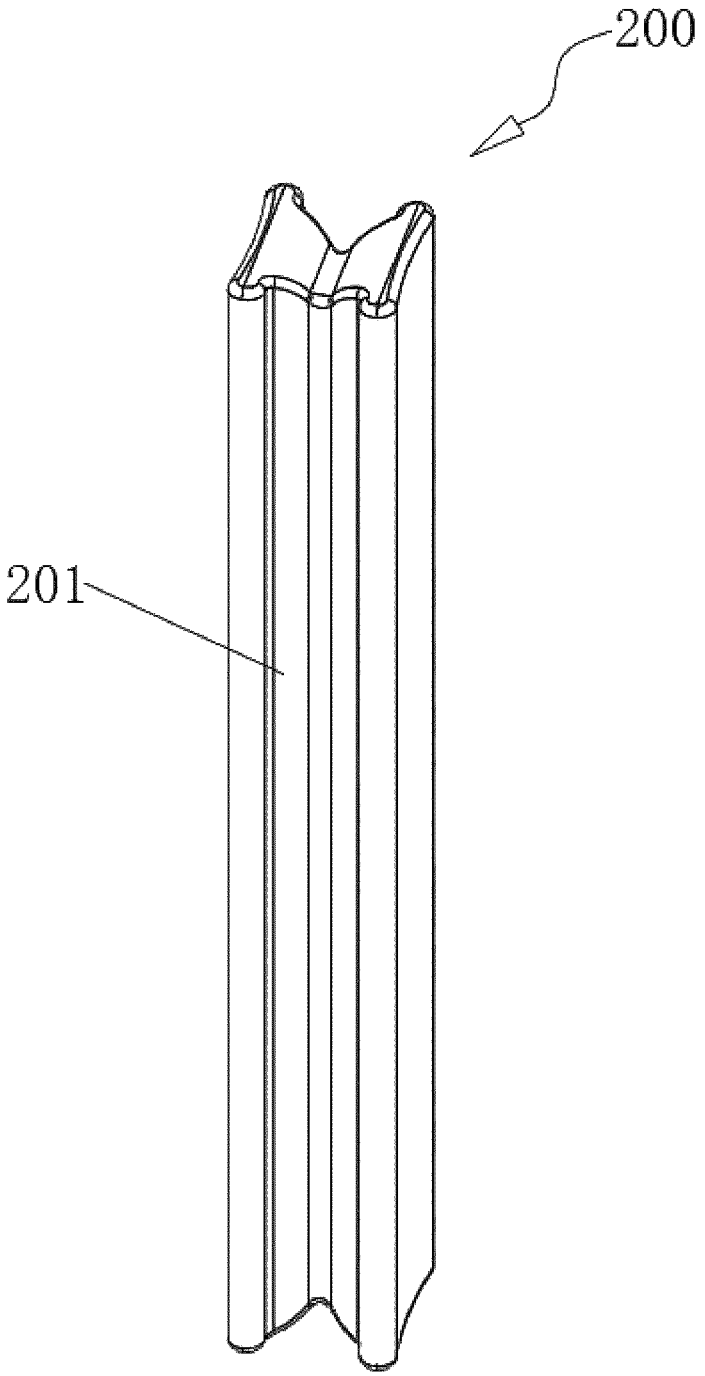
FIG. 6 is a schematic structural diagram of Embodiment 2 of the connector of the present invention.

As shown in FIG. 6, a connector 200 is arranged between two basic elements 100, and the connector 200 is long-strip shaped. At least two ends of the connector 200 are provided with dovetail strips 201, and the dovetail strips 201 at both ends of the connector 200 are installed between the two basic elements 100 in a mutually matched manner, wherein the cross section from the length direction of the dovetail strips 201 is roughly isosceles trapezoid. In some embodiments (not shown in the figure), the cross section of dovetail strip 201 may be inverted T-shaped, triangular, etc. By arranging the dovetail grooves 104 corresponding to the dovetail strips 201 of the connector 200 on the rolling surface 103 on the outer surface of the basic element 100, when a child needs to combine two or more rollers 101, the dovetail strips 201 at both ends of the connector 200 can be slidably inserted into the dovetail grooves 104 opposite to the two rollers 101, thereby connecting two or more basic elements 100 to form different combinations.

Figure 3:
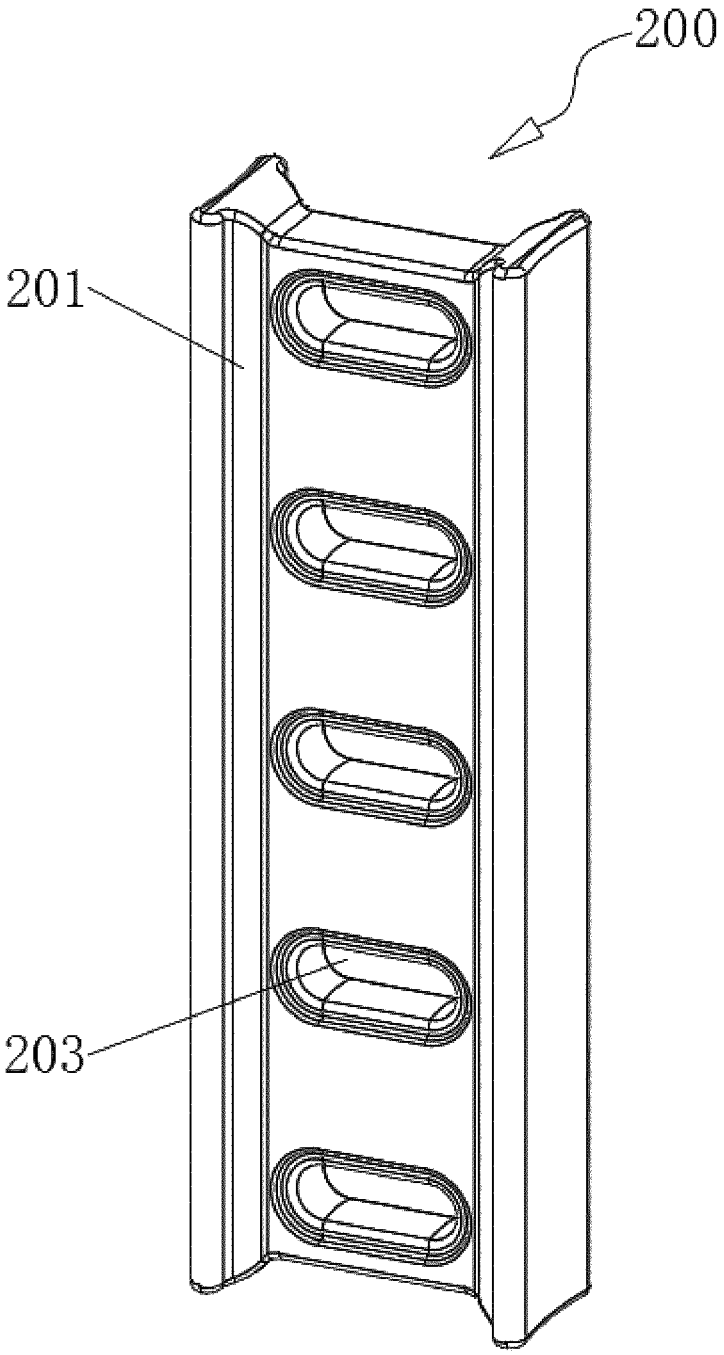
FIG. 3 is a schematic structural diagram of Embodiment 1 of the connector of the present invention.
Figure 4:
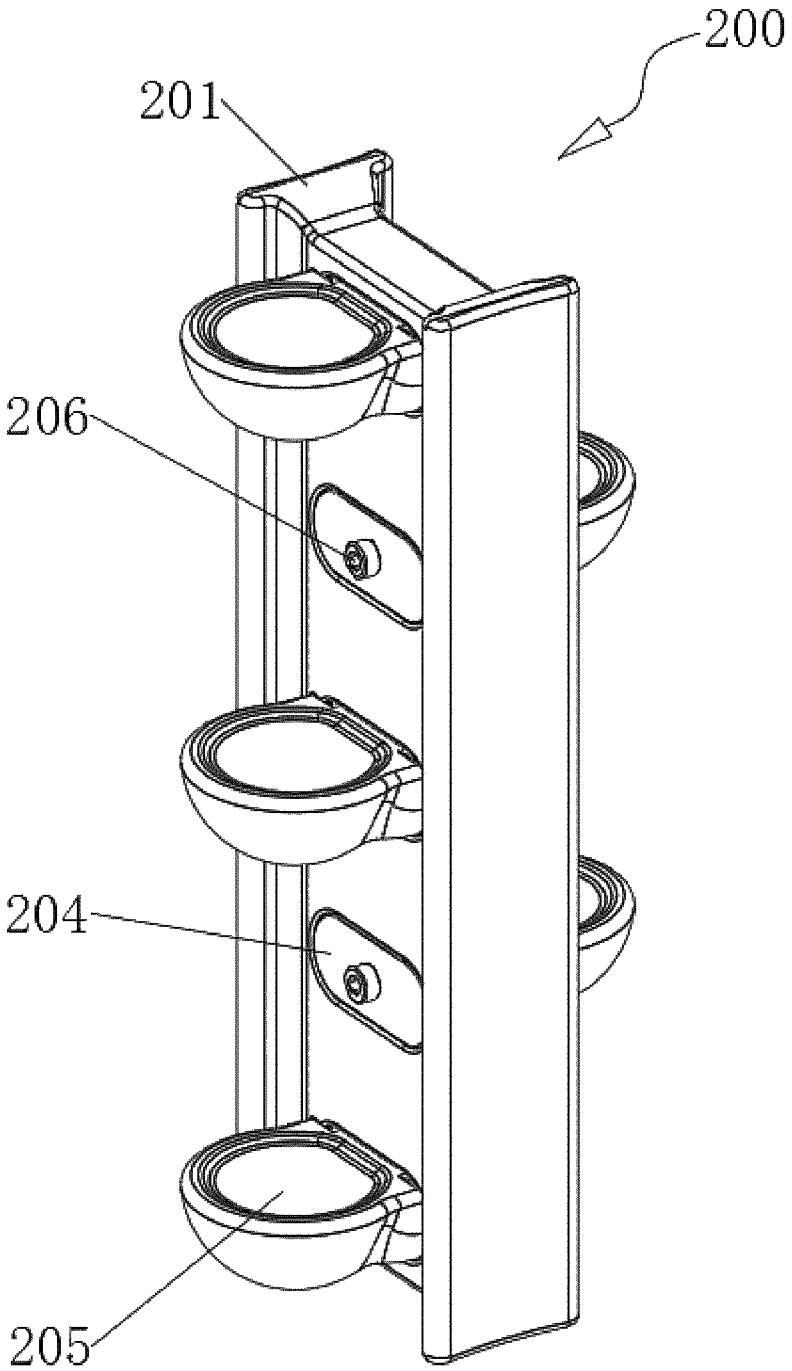
FIG. 4 is a schematic structural diagram of the installation of steps in the connector of FIG. 3.
Figure 5:
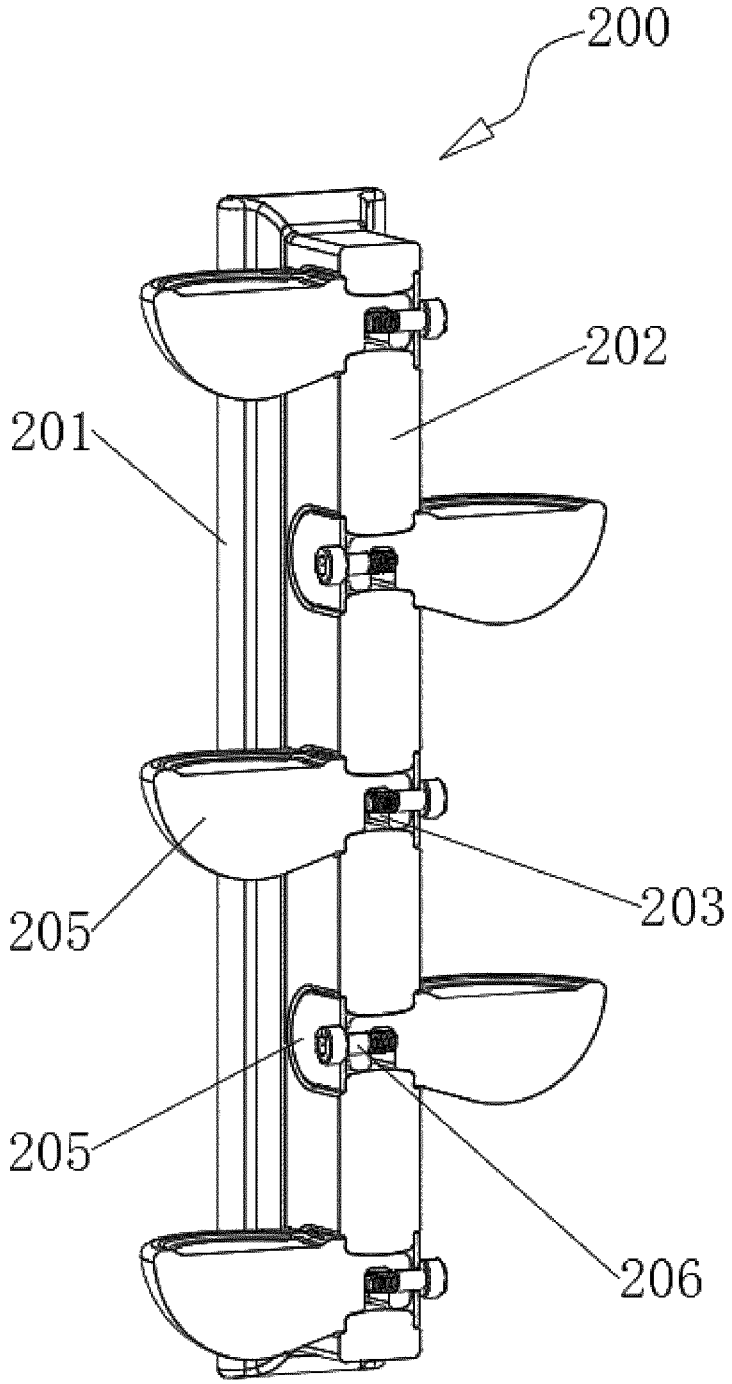
FIG. 5 is a sectional view of FIG. 4 of the present invention.
Figure 7:
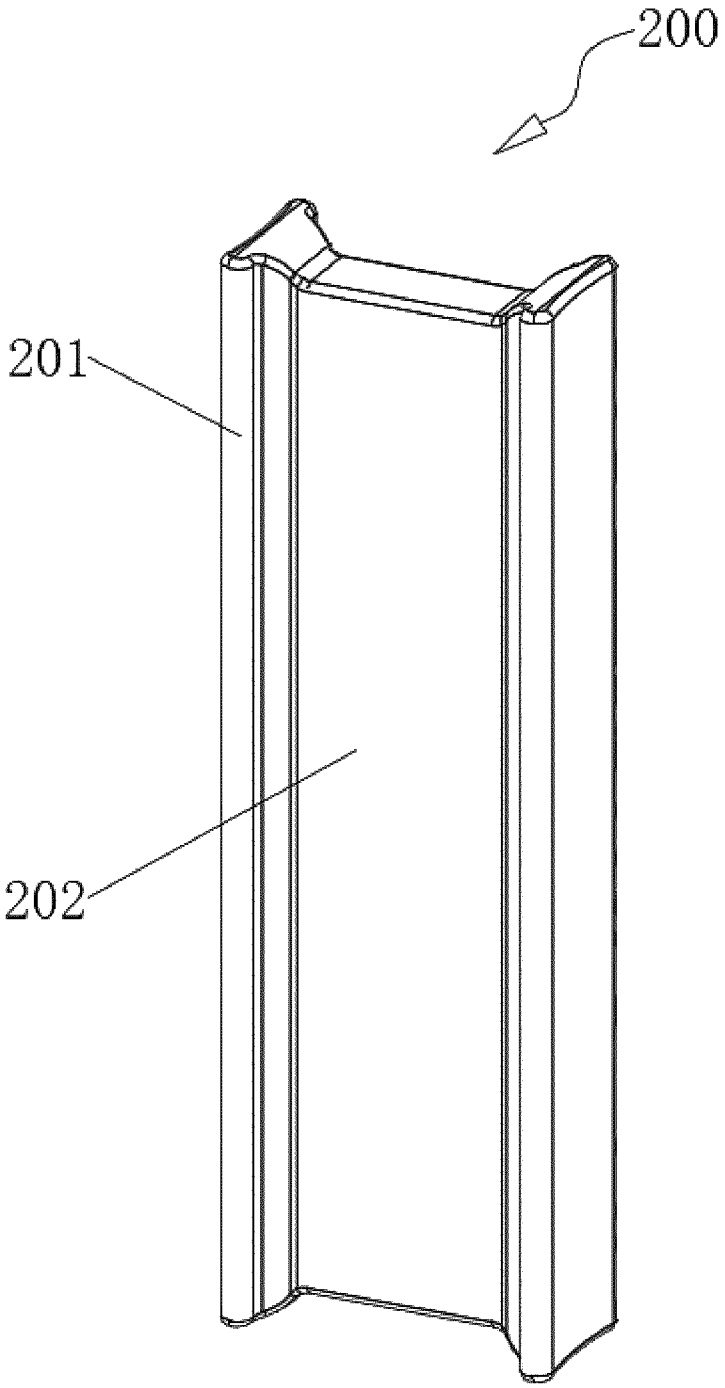
FIG. 7 is a schematic structural diagram of Embodiment 3 of the connector of the present invention.
Figure 8:
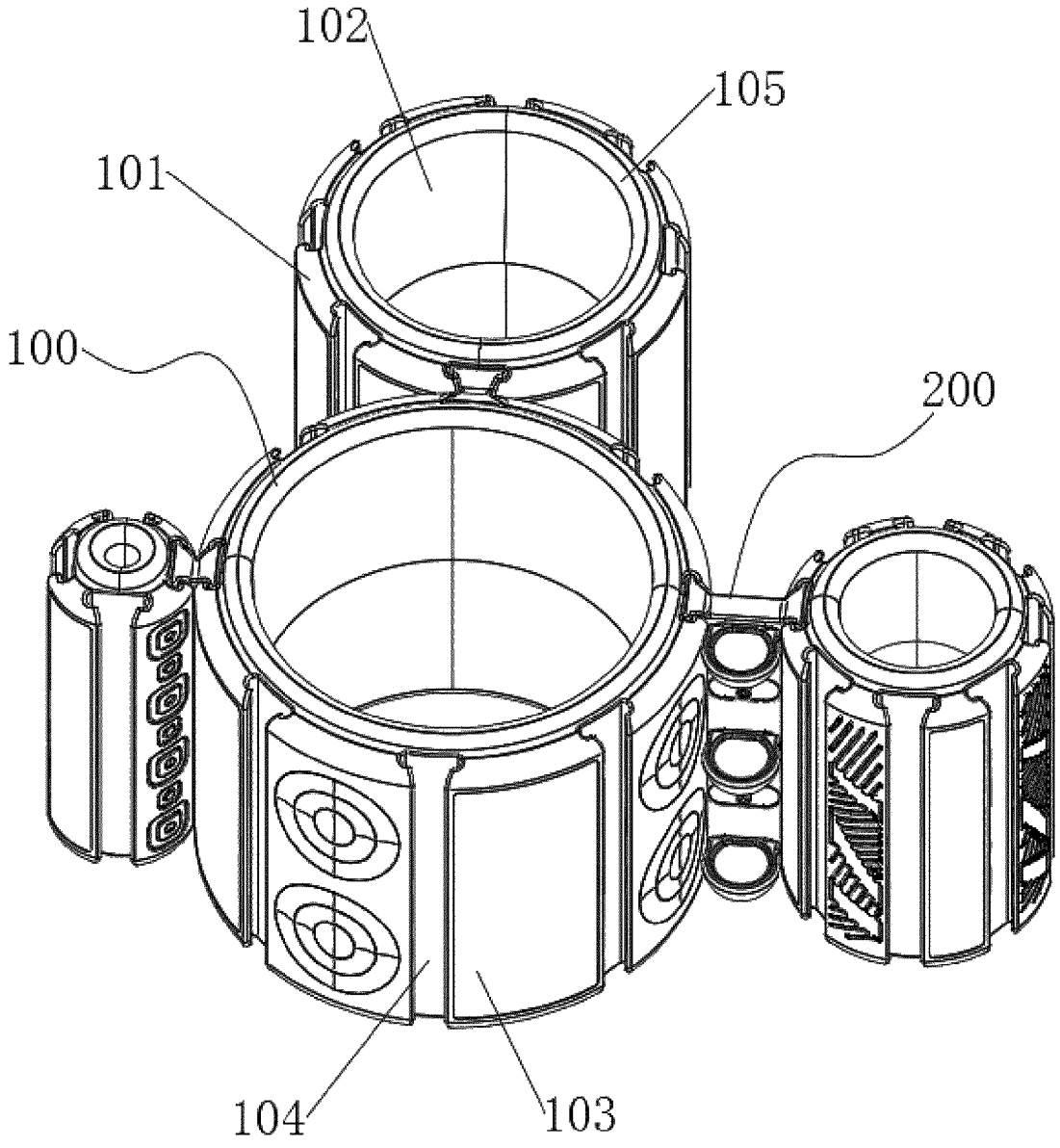
FIG. 8 is a state diagram when the basic elements of the present invention are assembled.
Figure 9:
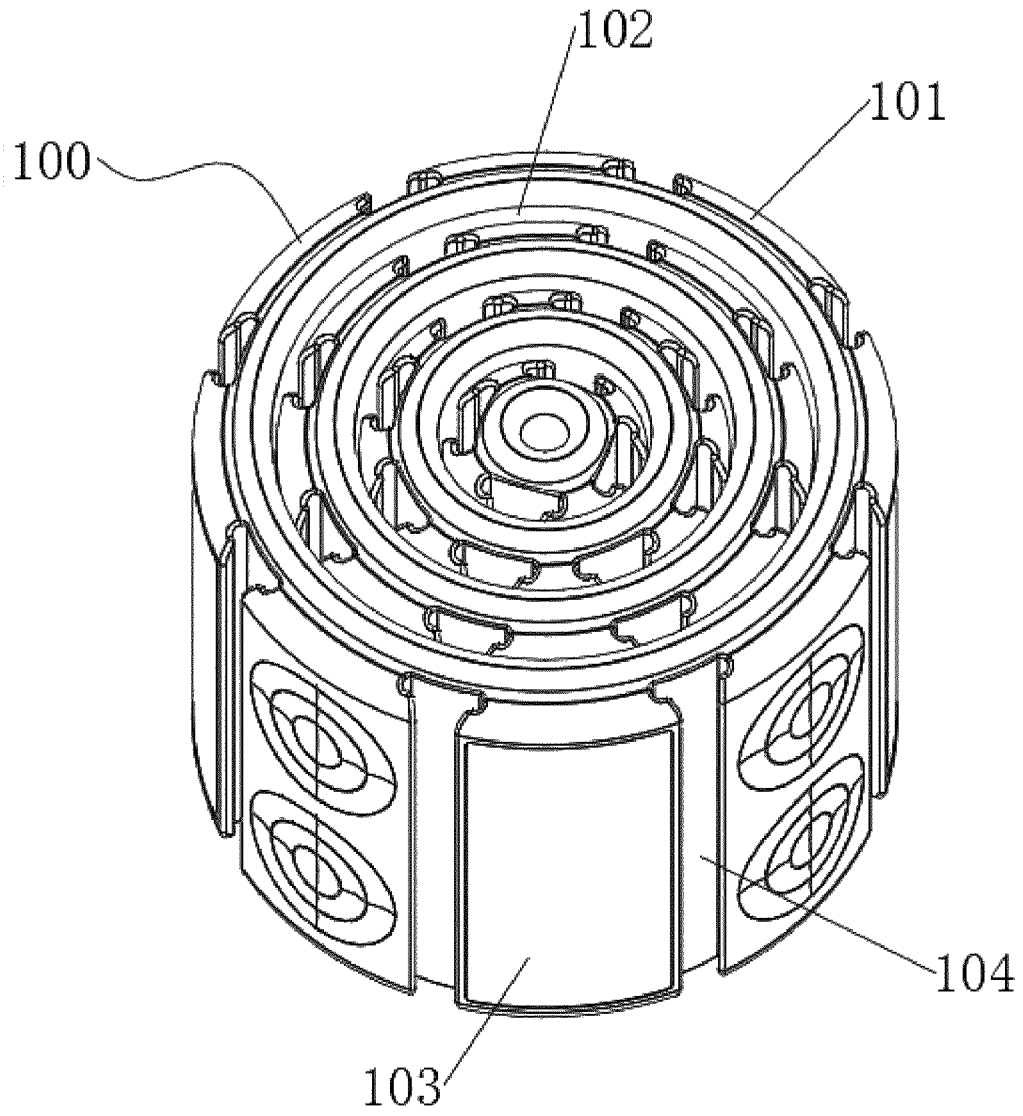
FIG. 9 is a state diagram when the basic elements of the present invention are nested.

As shown in FIG. 7, an extension part 202 for increasing the connection distance is arranged between the dovetail strips 201 at both ends of the connector 200, and the extension part 202 can be customized and adjusted as required to meet the connection distance requirements of different combinations. In addition, it can provide additional support and stability, thus enhancing the reliability and durability of the connector. In some embodiments, as shown in FIGS. 3 to 5, a plurality of rectangular mounting grooves 203 are uniformly formed on the front and rear surfaces of the extension part 202 from top to bottom. One end of the mounting groove 203 is embedded with a connecting plate 204, and the step 205 is inserted into the other end of the mounting groove 203, and a bolt 206 is inserted between the connecting plate 204 and the step 205.

Specifically, the mounting groove 203 is a substantially rectangular through hole, which is arranged on the extension part 202 in a penetrating manner, and the connecting plate 204 is in a substantially plate shape. A through hole is arranged in the center of the connecting plate 204, which can be used for the bolt 206 to pass through to fix the step 205. One end of the step 205 inserted into the mounting groove 203 is substantially rectangular, which is opposite to the shape of the mounting groove 203, and the end of the step 205 facing away from the mounting groove 203 is semicircular.

In this embodiment, when it is necessary to combine the step 205 with the connector 200, the step 205 can be inserted into one end of the mounting groove 203, and the connecting steps 205 are fixedly connected by the bolt 206 through the connecting plate 204 embedded in the other end of the mounting groove 203, so that the step 205 and the connector 200 can be firmly connected. The steps 205 can be detachably installed through the mounting grooves 203 provided on the connector 200, the vertical climbing game is realized in space, so that children can climb and play and exercise their physical coordination. When children climb, the bolt 206 and the connecting plate 204 will fix the step 205, thereby improving the stability of the steps 205 and ensuring certain safety.

In other implementations (not shown in the figure), the outline of the step 205 is not limited to semi-circle, but can also be customized according to specific application requirements, for example, triangular outline can be selected to save materials and reduce manufacturing costs, and rectangular outline can also be selected to increase the stability and bearing capacity of the step. In addition, children can also choose other geometric shapes, such as ellipse and polygon, according to their personal preferences or specific scene requirements. This diversified structure can meet the individual needs of different children and bring greater convenience and applicability to the use of the connector 200.

Figure 10:
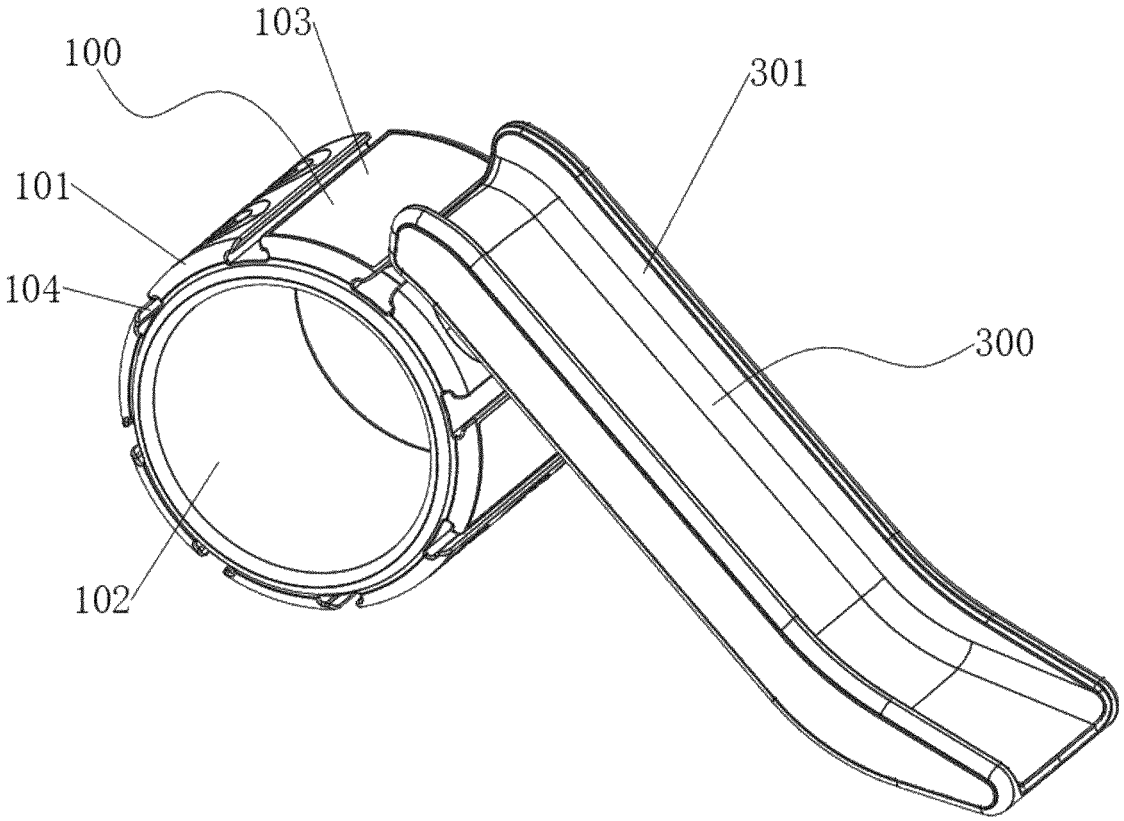
FIG. 10 is a schematic diagram of the structure when the present invention is expanded.
Figure 11:
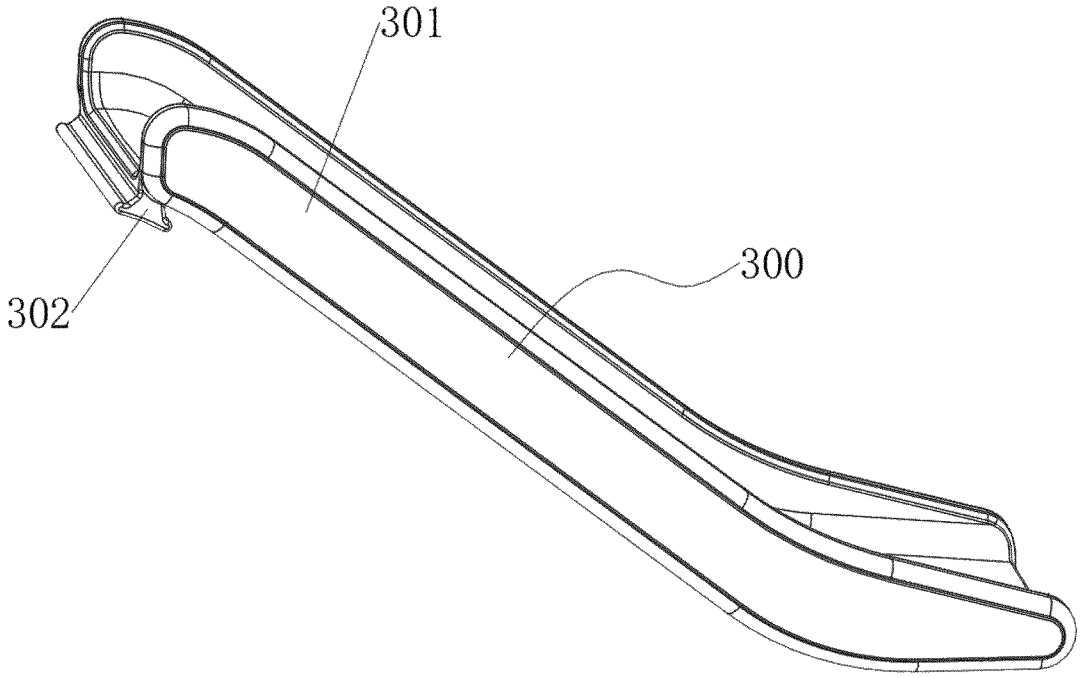
FIG. 11 is a structural schematic diagram of one embodiment of the expansion element of the present invention.

As shown in FIGS. 10 and 11, the expansion element 300 includes a slide 301, and one end of the slide 301 is provided with a connecting part 302 integrally formed with it, and the connecting part 302 is detachably connected with the dovetail groove 104 provided on the roller 101. Wherein, the slide 301 has a roughly sliding trapezoid shape, which is formed by two parallel retaining edges on the left and right sides and a plate body with a straight middle. The shape of the connecting part 302 is corresponding to the dovetail groove 104 provided on the roller 101.

Specifically, the expansion element 300 is integrally formed, and the retaining edges of the slide 301 and the outer surface of the plate body are both configured as glossy surface, so that children can slide and play more easily, and the retaining edges of the slide 301 is configured as an arc, which can effectively avoid the danger of right angles to children, and at the same time, the arc-shaped retaining edge is easier to be grasped by children. In some embodiments (not shown in the figure), in order to further ensure the safety of children when they play, anti-skid lines or anti-skid bumps are also arranged on the outer surface of the slide 301, so as to slow down the speed of children when they slide and reduce the danger caused by children falling off the edge too fast when they slide.

Embodiment 2

As a preferred embodiment of the application of the present invention, the application of the present invention also provides a multifunctional toy for early childhood education, which includes a plurality of basic elements 100, connectors 200 and expansion elements 300. A connector 200 is arranged between at least two basic elements 100, and the connector 200 is detachably connected between the two basic elements 100; the expansion elements 300 are detachably connected with the basic elements 100.

As shown in FIG. 2, the basic element 100 includes a roller 101, and dovetail grooves 104 are formed on the outer circumferential surface of the roller 101. The dovetail grooves 104 are arranged along the length direction of the roller 101 in a penetrating manner up and down. The dovetail groove 104 has an opening along the sagittal direction of the roller 101. The shape of the dovetail groove 104 is corresponding to that of the dovetail strip 201, and both ends of the dovetail groove 104 are provided with openings to accommodate the connector 200.

As shown in FIG. 6 to FIG. 7, at least two ends of the connector 200 are provided with dovetail strips 201, and an extension part 202 for increasing the connection distance is arranged between the dovetail strips 201 at both ends, and the dovetail strips 201 at both ends are used for being inserted into the dovetail grooves 104 of the two rollers 101 respectively. Wherein, the cross section of the dovetail strip 201 from the length direction is generally isosceles trapezoid, and in some embodiments (not shown in the figure), the cross section of the dovetail strip 201 can be T-shaped, triangular, etc. A dovetail groove 104 corresponding to the dovetail strip 201 of the connector 200 is provided through the rolling surface 103 on the outer surface of the basic element 100. When children need to combine two or more rollers 101, the dovetail strips 201 at both ends can be respectively inserted into the dovetail grooves 104 opposite to the two rollers 101 in a sliding way, thereby connecting two or more basic elements 100 to form different combinations. Wherein, the extension part 202 of the connector 200 can be customized and adjusted as needed to meet the connection distance requirements of different combinations. In addition, it can provide additional support and stability, thus enhancing the reliability and durability of the connector.

As shown in FIGS. 10 to 11, the expansion element 300 includes a slide 301, and one end of the slide 301 is provided with a connecting part 302 integrally formed with it, and the connecting part 302 is detachably connected with the dovetail groove 104 provided on the roller 101. Wherein, the slide 301 has a roughly sliding trapezoid shape, which is formed by two parallel retaining edges on the left and right sides and a plate body with a straight middle. The shape of the connecting part 302 is corresponding to the dovetail groove 104 provided on the roller 101.

Specifically, the expansion element 300 is integrally formed, and the retaining edge of the slide 301 and the outer surface of the plate body are both configured as glossy surface, so that children can slide and play more easily, and the retaining edge of the slide 301 is configured as an arc, which can effectively avoid the danger of right angles to children, and at the same time, the arc-shaped retaining edge is easier to be grasped by children. In some embodiments (not shown in the figure), in order to further ensure the safety of children when they play, anti-skid lines or anti-skid bumps are also arranged on the outer surface of the slide 301, so as to slow down the speed of children when they slide and reduce the danger caused by children falling off the edge too fast when they slide.

Embodiment 3

As a preferred embodiment of the application of the present invention, the application of the present invention further provides a multifunctional toy for early childhood education, which includes a plurality of rollers 101 and at least one expansion element 300, wherein a connector 200 is arranged between at least two rollers 101, and the connector 200 is detachably connected between the two rollers 101; and the expansion element 300 is detachably connected with the roller 101.

As shown in FIG. 2, a plurality of dovetail grooves 104 are uniformly arranged on the outer circumferential surface of the roller 101; a connector 200 is arranged between at least two rollers 101, and the connector 200 is detachably connected between two dovetail grooves 104 of two rollers 101 facing each other, and the expansion element 300 is detachably connected with the rollers 101.

Specifically, the dovetail groove 104 is roughly in the shape of a guide rail, which is arranged on the roller 101 in a penetrating manner from top to bottom along the length direction of the roller 101, and the dovetail groove 104 is provided with an opening along the sagittal direction of the roller 101. The dovetail groove 104 is corresponding to the dovetail strip 201 in shape, and both ends of the dovetail groove 104 are provided with openings to accommodate the connectors 200. The connector 200 is long-strip shaped, and at least two ends of the connector 200 are provided with dovetail strips 201, and the dovetail strips 201 at both ends of the connector 200 are installed between the two basic elements 100 in a mutually matched manner, wherein the cross section from the length direction of the dovetail strips 201 is roughly isosceles trapezoid. By arranging the dovetail grooves 104 corresponding to the dovetail strips 201 of the connector 200 on the outer surface of the basic element 100, when children need to combine two or more rollers 101, the dovetail strips 201 at both ends can be inserted into the dovetail grooves 104 opposite to the two rollers 101 in a sliding way, so as to connect the two or more rollers 101 to form different combinations.

As shown in FIGS. 10 to 11, the expansion element 300 includes a slide 301, one end of the slide 301 is provided with a connecting part 302 integrally formed with it, and the connecting part 302 is detachably connected with the dovetail groove 104 provided on the roller 101. In some embodiments (not shown in the figure), the retaining edges of the slide 301 and the outer surface of the board are both configured as glossy surface, so that children can slide and play more easily, and the retaining edge of the slide 301 is configured as an arc, which can effectively avoid the danger of right angles to children, and at the same time, the arc-shaped retaining edge is easier to be grasped by children. In some embodiments (not shown in the figure), in order to further ensure the safety of children when playing, the outer surface of the slide 301 is also provided with anti-skid lines or anti-skid bumps, so as to slow down the speed of children when sliding, and reduce the danger caused by children falling off the edge too fast when sliding.

In some embodiments (not shown in the figure), the expansion element 300 can also be a ladder or stairs, which can provide a climbing experience space full of fun and challenges for children. Children are allowed to exercise their physical coordination and strength in the process of exploration and climbing.

In some embodiments (not shown in the figure), the expansion element 300 can also be a long plate, and its connecting part 302 is located in the middle of the bottom of the plate and connected with the roller 101. Therefore, when the roller 101 is placed upside down and the rolling surface 103 is in contact with the ground, a seesaw can be formed between the roller 101 and the plate. The roller 101 is used as a supporting point, so that both ends of the plate can be tilted back and forth. In this way, children can play on the seesaw, which is composed of the roller 101 and the plate, so as to exercise their sense of balance and physical coordination.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state.

The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. A multifunctional toy for early childhood education, comprising a plurality of basic elements and at least one expansion element;

wherein, a basic element of the plurality of basic elements has a rollable outer surface and an inner cavity for sleeving other basic elements;

wherein, a connector is arranged between at least two basic elements of the plurality of basic elements, and the connector is installed between the at least two basic elements in a mutually matched manner;

wherein, the connector is detachably connected with a plurality of steps; and wherein the at least one expansion element is detachably connected with a basic element of the plurality of basic elements.

2. The multifunctional toy for early childhood education according to claim 1, wherein each of the plurality of basic elements is a roller, and the sizes of a plurality of the rollers are different.

3. The multifunctional toy for early childhood education according to claim 2, wherein the inner cavity of the roller of a respective basic element is set as a sleeving area, and the sleeving area is configured to be used for sleeving other rollers of the plurality of basic elements.

4. The multifunctional toy for early childhood education according to claim 2, wherein an outer circumferential surface of the roller of each of the plurality of basic elements is set as a rolling surface, and the roller of each of the plurality of basic elements rolls through the rolling surface.

5. The multifunctional toy for early childhood education according to claim 4, wherein both end faces of the roller of each of the plurality of basic elements perpendicular to the rolling surface are set as upright end faces, and the roller of each of the plurality of basic elements is vertically placed through the upright end faces.

6. The multifunctional toy for early childhood education according to claim 4, wherein a plurality of dovetail grooves are uniformly formed on the rolling surface, and both ends of the plurality of dovetail grooves are open.

7. The multifunctional toy for early childhood education according to claim 6, wherein the connector is long-strip shaped, and at least two ends of the connector are provided with dovetail strips, and the dovetail strips at both of the at least two ends are configured to be used for being inserted into two dovetail grooves of a respective two rollers of the plurality of basic elements.

8. The multifunctional toy for early childhood education according to claim 7, wherein a plurality of mounting grooves are evenly arranged between two surfaces of the connector parallel to the dovetail strips from top to bottom.

9. The multifunctional toy for early childhood education according to claim 8, wherein a connecting plate is embedded in one end of a mounting groove of the plurality of mounting grooves, one of the plurality of steps is inserted into the other end of the mounting groove, and a bolt is inserted between the connecting plate and said one of the plurality of steps.

10. The multifunctional toy for early childhood education according to claim 6, wherein the at least one expansion element is a slide, and one end of the at least one expansion element is provided with a connecting part integrally formed therewith, and the connecting part is arranged corresponding to a dovetail groove of the plurality of dovetail grooves and can be inserted into the dovetail groove.

11. A multifunctional toy for early childhood education, comprising a plurality of basic elements and at least one expansion element;

wherein, a connector is arranged between at least two basic elements of the plurality of basic elements;

wherein, the connector is detachably connected between the at least two basic elements; and wherein, the at least one expansion element is detachably connected with a basic element of the plurality of basic elements; and wherein each of the plurality of basic elements is a roller, and an outer surface of the roller is uniformly provided with a plurality of dovetail grooves.

12. The multifunctional toy for early childhood education according to claim 11, wherein at least two ends of the connector are provided with dovetail strips, and the dovetail strips at both ends are configured to be used for being inserted into two dovetail grooves of a respective two rollers of the plurality of basic elements.

13. The multifunctional toy for early childhood education according to claim 12, wherein an extension part for increasing a connection distance is arranged between the dovetail strips at both ends.

14. The multifunctional toy for early childhood education according to claim 12, wherein one end of the at least one expansion element is provided with a connecting part, and the connecting part is inserted into a dovetail groove of the plurality of dovetail grooves.

15. A multifunctional toy for early childhood education, comprising a plurality of rollers and at least one expansion element;

wherein a connector is arranged between at least two rollers of the plurality of rollers, and the connector is detachably connected between the at least two rollers;

wherein the at least one expansion element is detachably connected with a roller of the plurality of rollers; and wherein a plurality of dovetail grooves are uniformly formed at an outer circumferential surface of the plurality of rollers, and the connector is inserted between two dovetail grooves facing each other and present on a respective two rollers of the plurality of rollers.

16. The multifunctional toy for early childhood education according to claim 15, wherein the at least one expansion element is a slide, one end of the slide is provided with a connecting part, and the connecting part is inserted into a dovetail groove of the plurality of dovetail grooves.

* * * * *